US009506478B2

(12) United States Patent
Legge et al.

(10) Patent No.: US 9,506,478 B2
(45) Date of Patent: Nov. 29, 2016

(54) VACUUM SYSTEM

(75) Inventors: Graham Thomas Legge, Philadelphia, PA (US); Michael Andrew Galtry, Worthing (GB)

(73) Assignee: Edwards Limited, Crawley (GB)

( * ) Notice: Subject to any disclaimer, the term of this patent is extended or adjusted under 35 U.S.C. 154(b) by 520 days.

(21) Appl. No.: 13/350,418

(22) Filed: Jan. 13, 2012

(65) Prior Publication Data

US 2013/0180596 A1 Jul. 18, 2013

(51) Int. Cl.

| | |
|---|---|
| ***F04F 3/00*** | (2006.01) |
| ***F04B 49/24*** | (2006.01) |
| ***F04B 49/035*** | (2006.01) |

(52) U.S. Cl.

CPC ..... *F04F 3/00* (2013.01); *F04B 49/035* (2013.01); *F04B 49/24* (2013.01); *Y10T 137/0396* (2015.04); *Y10T 137/86083* (2015.04)

(58) Field of Classification Search

CPC .... F04B 49/24; F04B 49/035; F04D 29/708; F04F 3/00; Y10T 137/0396; Y10T 137/86083

USPC ..... 417/53, 278, 279, 307, 309, 423.9, 440

See application file for complete search history.

(56) References Cited

U.S. PATENT DOCUMENTS

| | | | | |
|---|---|---|---|---|
| 3,922,110 | A * | 11/1975 | Huse | 417/2 |
| 4,505,647 | A * | 3/1985 | Alloca et al. | 417/252 |
| 5,259,735 | A * | 11/1993 | Takahashi et al. | 417/203 |
| 5,369,811 | A * | 12/1994 | Serre | 4/213 |
| 5,814,741 | A * | 9/1998 | Wang et al. | 73/863.12 |
| 6,106,626 | A * | 8/2000 | Guan et al. | 118/715 |
| 6,446,651 | B1 * | 9/2002 | Abbel | 137/1 |
| 7,525,106 | B2 * | 4/2009 | Imoto et al. | 250/492.2 |
| 2009/0084315 | A1 * | 4/2009 | Liu et al. | 118/715 |

* cited by examiner

*Primary Examiner* — Devon Kramer
*Assistant Examiner* — Charles Nichols
(74) *Attorney, Agent, or Firm* — Shumaker & Sieffert, P.A.

(57) ABSTRACT

The present invention relates to a vacuum system for evacuating a chamber of a metallurgical processing system. The system comprises a vacuum pumping arrangement for evacuating gas from the chamber, a foreline connecting the vacuum pumping arrangement to the chamber, a filter volume located in the foreline for filtering gas evacuated from the chamber along the foreline, and a by-pass line connecting the vacuum pumping arrangement to the chamber and arranged to by-pass the filter volume selectively dependent on monitored characteristics of the degassing chamber or the vacuum system.

14 Claims, 2 Drawing Sheets

VACUUM SYSTEM

The present invention relates to a vacuum system for steel degassing and a method of evacuating a vacuum degassing chamber.

Vacuum degassing processes are often used in metallurgical processes for example in the production of specialty steel alloys by degassing or decarburizing. In steel degassing processes, they are used to reduce the levels of hydrogen, carbon and other impurities during the secondary steel making process. A known degassing system comprises a degassing chamber 40 which is connected to a vacuum system 42, as shown in FIG. 3. The vacuum system comprises a vacuum pumping arrangement 44 connected to the chamber 40 by a foreline 46. The foreline comprises a filter 48 for filtering gas conveyed from the chamber and an isolation valve 50 for isolating the filter from the chamber. The filter prevents damage to components of the vacuum system, particularly the vacuum pumping arrangement caused by steel dust evacuated from the chamber. The chamber 40 is usually 100 $m^3$ or more and the filter volume is typically at least a third of the volume of the chamber and generally approximately equal in volume. In a 100 tonne (meltsize) degasser, a typical volumetric flow of 120,000 m3/hr at 0.67 mb can be expected and in order to filter this volumetric flow the surface area of the filters must be large. This large surface area gives rise to the requirement for a large filter volume.

In known methods, the filter volume is evacuated prior to start of the process to around 10 mbar, and on commencement of the process, the isolation valve 50 is opened and the pressure differential causes gas to flow from the chamber into the filter volume so that both the chamber and the filter volume equalize to about 600 mbar. In this way, an immediate reduction in pressure in the chamber is achieved. Subsequently, the vacuum pumping arrangement evacuates gas from the chamber and the filter volume along the foreline to a target pressure which is typically 1 mbar.

The present invention provides an improved vacuum system.

The present invention provides a vacuum system for evacuating a steel degassing chamber, the system comprising: a vacuum pumping arrangement for evacuating gas from the chamber, a foreline connecting the vacuum pumping arrangement to the chamber, a filter volume located in the foreline for filtering gas evacuated from the chamber along the foreline, and a by-pass line connecting the vacuum pumping arrangement to the chamber and arranged to by-pass the filter volume selectively dependent on monitored characteristics of the degassing chamber or the vacuum system.

The present invention also provides a method of evacuating a steel degassing chamber, the method comprising isolating a filter volume from the chamber and a vacuum pumping arrangement, and evacuating the chamber from atmosphere to a pressure less than atmosphere with a vacuum pumping arrangement.

In order that the present invention may be well understood, an embodiment thereof, which is given by way of example only, will now be described with reference to the accompanying drawings, in which.

Figure 1:
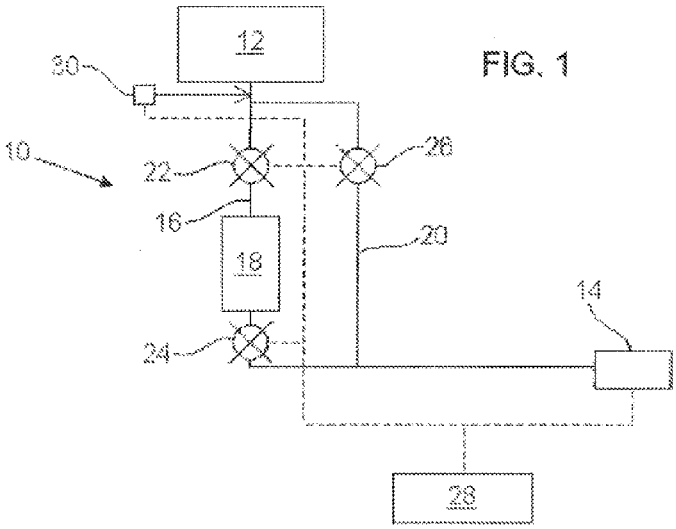
FIG. 1 shows a vacuum system for evacuating a steel degassing chamber.
Figure 3:
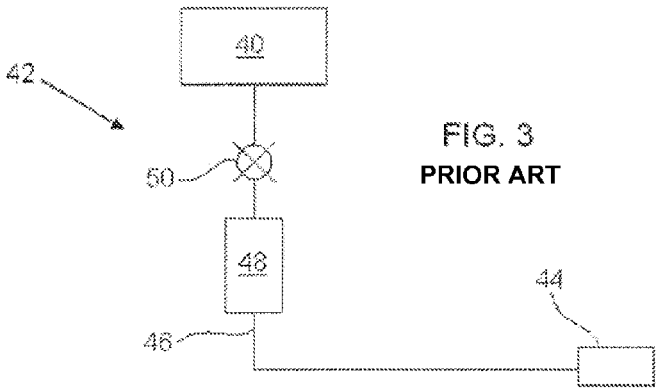
FIG. 3 PRIOR ART
FIG. 3 shows a known vacuum system for evacuating a steel degassing chamber.

Referring to FIG. 1, a vacuum system 10 is shown for evacuating a chamber of a metallurgical processing system, such as a steel degassing or decarburizing chamber 12. The system comprises a vacuum pumping arrangement 14 for evacuating gas from the chamber. The vacuum pumping arrangement may comprises one or more vacuum pumps. A foreline 16 connects the vacuum pumping arrangement to the chamber so that gas and other gas-borne substances, such as particulates, can be pumped from the chamber by the vacuum pump. The gas exhausted from the vacuum pumping arrangement may be treated, contained or exhausted to atmosphere. A filter volume 18 is located in the foreline for filtering gas evacuated from the chamber along the foreline. The filter volume is itself known in vacuum systems for degassing chambers and has a volume which is generally comparable with the volume of the chamber. In the present example, the filter volume is arranged to filter steel dust from the chamber gas conveyed along the foreline. A by-pass line 20 connects the vacuum pumping arrangement 14 to the chamber 12 and is arranged to by-pass the filter volume selectively dependent on monitored characteristics of the vacuum system or chamber such as pressure in the chamber or time elapsed since commencing chamber pump down (evacuation). The monitored characteristic or characteristics should be selected to trigger the vacuum system to convey gas through the filter volume rather than the by-pass line prior to any significant evacuation of damaging dust from the chamber.

The chamber 12 forms part of a steel degassing system known in the art. The chamber is large and is typically in the region 100 $m^3$ in volume or more. The filter volume 18 is also large typically being approximately a third of the volume of the chamber and often approximately equal in volume. As indicated above in relation to the prior art, the filter volume is evacuated prior to evacuation of the degassing chamber. A typical pressure of the filter volume is in the region of 10 mbar. When chamber evacuation is required, the filter volume is connected to the chamber and the pressure differential causes gas in the chamber to be conveyed into the filter volume thereby equalising pressure in the chamber and the filter volume. The equalised pressure may be in the region of 600 mbar. However, the present applicant has recognised that although this pressure equalisation causes an immediate reduction in chamber pressure prior to evacuation of gas by the vacuum pumping arrangement, gas is not removed from the system during the equalisation and the total mass content of gas in the chamber and filter volume remains constant. Moreover, the gas which was predominately contained in the chamber has instead been distributed over a larger, combined, volume and at lower pressure. For a given vacuum pumping arrangement, the pumping capacity, or rate, at which it removes mass content of gas from a volume is greater at higher pressures. Accordingly, the vacuum pumping arrangement in the known process removes the mass content of the combined volume at a slower speed at a lower pressure (e.g. 500-600 mbar) than would be the case if the pressure were higher (e.g. atmosphere). Since, in the prior art, the mass content of the combined volume must be reduced in order to achieve a target pressure in the chamber, the pump down speed of the chamber is slow compared to that which can be achieved by the vacuum system shown in FIG. 1.

In FIG. 1, the chamber 12 is connected to the vacuum pumping arrangement 14 by the by-pass line 20 so that the chamber is first evacuated from atmosphere (or its initial pressure) by the vacuum pumping arrangement 14. Since the pressure of the chamber is at a higher pressure than would be the case if it had first been connected to a pre-evacuated filter volume, the vacuum pumping arrangement can reduce the mass content of the chamber more quickly. That is, the vacuum pumping arrangement is operable at a pressure at which it is more efficient. When subsequently, the filter volume is connected to the chamber and equalisation occurs, the combined mass content of the chamber and the filter volume has already been reduced and therefore the target pressure of the chamber (and the filter volume) can be achieved in less time.

The foreline 16 is arranged to isolate the filter volume 18 from the chamber 12 and the vacuum pumping arrangement 14 when the by-pass line connects the vacuum pumping arrangement to the chamber. Isolating the filter volume from the chamber is required to maintain the chamber at a higher pressure during initial evacuation by the vacuum pumping arrangement. Additionally, isolating the filter volume from the vacuum pumping arrangement reduces the amount of work done by the vacuum pumping arrangement. In FIG. 1, the foreline comprises a first isolation valve 22 upstream of the filter volume 18 for isolating the filter volume from the chamber and a second isolation valve 24 downstream from the filter volume for isolating the filter volume from the vacuum pumping arrangement.

A by-pass valve 26 selectively conveys gas along the by-pass line 20 dependent on the pressure in the chamber. The by-pass valve is open during an initial pumping stage to allow gas to be conveyed along the by-pass line. The isolation valve 22 which is closed causes gas to be conveyed through the by-pass line. The by-pass valve and isolation valve 22 could be integrated. When it is required that gas is conveyed through the filter, the by-pass valve is closed otherwise gas would follow the path of least resistance along the by-pass line rather than being conveyed through the filter volume 18.

A control device 28 is configured for controlling operation of the vacuum system. The control may be integral with the control of the vacuum pumping arrangement or may be separate and comprise a programmable logic device or computer for example. In FIG. 1, the control is connected by control lines (shown in broken lines) to the valves 22, 24, 26 and if required the vacuum pumping arrangement 14. It may also be connected to a pressure sensor 30 for sensing the pressure in the chamber, in the foreline immediately downstream of the chamber or in another suitable part of the system.

The control 28 is arranged/configured to control the flow of gas from the chamber to the vacuum pumping arrangement along the by-pass line at a first range of pressures. Significant amounts of dust and other gas-borne constituents are not evacuated from the chamber during this initial evacuation from atmosphere. However, at approximately 150 mbar steel dust is formed and therefore to avoid damage to the vacuum pumping arrangement, the gas must first be passed through the filter volume 18. Therefore, the lower end of the first range of pressures is selected to avoid dust being conveyed through the by-pass line. In this regard, a pressure of between 200-250 mbar is considered to allow a sufficient safety margin. Accordingly, at a predetermined pressure of for example 250 mbar, the by-pass valve 26 is closed and the isolation valves 22, 24 are opened. When the isolation valve 22 is opened the gas in the chamber (at 250 mbar) is conveyed into the filter volume 18 (at 10 mbar) causing a reduction in chamber pressure to between 250 mbar and 10 mbar (e.g. about 100 mbar). When the isolation valve 24 is opened, gas at the equalized lower pressure is conveyed from the vacuum chamber 12 to the vacuum pumping arrangement through foreline 16 and the filter volume 18. Therefore, the process described comprises initial evacuation through the by-pass line, equalization of chamber and filter volume, and then subsequent pump down through the filter. Subsequent pump down may begin after or during equalization and therefore may occur at a second range of pressure having an upper limit of between about 100 and 250 mbar and a lower limit of the target pressure (e.g. 1 mbar). That is, it is not necessary to delay evacuation by the vacuum pumping arrangement until full equalization has occurred. Accordingly, whilst the first range of pressures is higher than the second range of pressures, the lower limit of the first range may not be the same as the upper limit of the second range. Additionally, it will be noted that the pre-evacuated filter is connected to the chamber for equalization at a pressure less than the initial pressure of the chamber. Whilst it is preferable that evacuation occurs through the by-pass line until there is a risk of dust being generated, the switch between the by-pass and foreline may take place at a higher pressure whilst still achieving some benefits of the invention.

Figure 2:
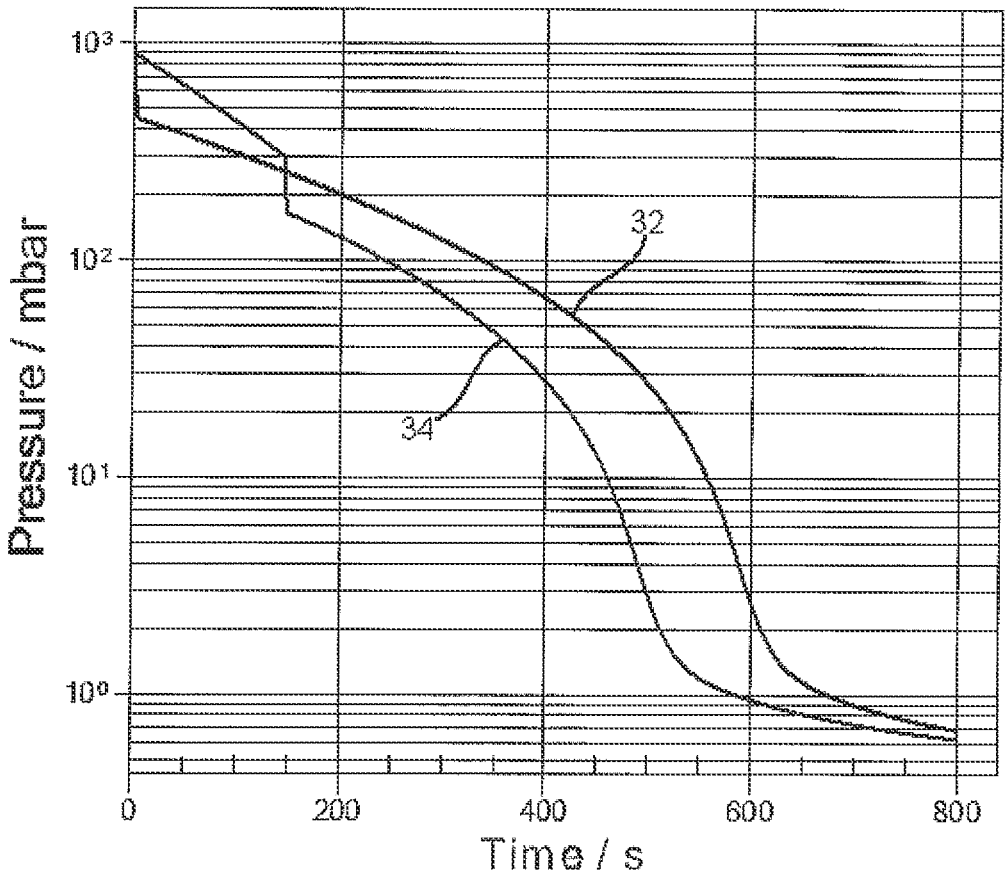
FIG. 2 shows a graph plotting chamber pressure against pump down time for the vacuum system shown in FIG. 1 and for a known vacuum system.

With reference to FIGS. 1 and 2, there will now be described a method of evacuating a steel degassing chamber. FIG. 2 shows pump down of chambers with pressure in mbar plotted against time in seconds for a prior art vacuum system and for a vacuum system as described in relation to FIG. 1.

In FIG. 2, line 32 shows the prior art system. From an initial chamber pressure of 1000 mbar (or atmosphere) at time 0, the filter volume is connected to the chamber causing a rapid reduction in pressure to 500-600 mbar. The chamber and the filter volume are then evacuated by a vacuum pumping arrangement reaching a target pressure of 1 mbar after about 675 seconds.

Line 34 of FIG. 2 shows the FIG. 1 arrangement. The chamber 12 is evacuated from atmosphere at time 0 to a pressure less than atmosphere with vacuum pumping arrangement 14 whilst isolating the filter volume 18 from the chamber and the vacuum pumping arrangement. In this example, the chamber is evacuated for 150 seconds to about 250 mbar. It will be seen that line 34 is steeper than line 32 over this period which represents the greater efficiency of the vacuum pumping arrangement at higher pressures in the FIG. 1 arrangement. This initial stage of chamber evacuation through the by-pass line may be timed to continue for a period of time (e.g. 150 seconds) or be dependent on the sensed pressure in the chamber (e.g. 250 mbar). It could alternatively be monitored by a mass flow sensor which senses the mass content of gas removed from the chamber.

The filter volume 18 is connected (opened) to the chamber via valve 22 after 150 seconds, at which time rapid evacuation of the chamber occurs as the pressure in the chamber and the filter volume equalize. From 150 seconds and subsequently, the filter volume and the chamber are evacuated by the vacuum pumping arrangement. The target pressure of 1 mbar is reached after about 580 seconds, which is around 100 seconds faster than with the prior art arrangement.

The filter volume may be evacuated by the vacuum pumping arrangement prior to commencing the degassing process, by for example opening isolation valve 24 and pumping down the filter volume, then closing the isolation valve 24 to maintain the desired pre-evacuated pressure in the filter volume. Filter evacuation is typically only required prior to the first cycle of the degassing process, since for subsequent cycles it will have been evacuated during the previous cycle and isolated when the previous cycle finishes. The by-pass valve 26 is then controlled so that gas is conveyed from the chamber to the vacuum pumping arrangement along the by-pass line. At this time, the isolation valves 22, 24 are controlled so that the filter volume is isolated from the chamber and the vacuum pumping arrangement. Subsequently, the by-pass valve 26 and the isolation valves 22, 24 are controlled so that gas is conveyed along the foreline and through the filter volume to the vacuum pumping arrangement.

The invention claimed is:

1. A vacuum system for evacuating a chamber of a metallurgical processing system, the vacuum system comprising:

the chamber;

a vacuum pumping arrangement for evacuating gas from the chamber;

a foreline connecting the vacuum pumping arrangement to the chamber, wherein the foreline is downstream of the chamber and upstream of the vacuum pumping arrangement;

a filter volume located in the foreline for filtering gas evacuated from the chamber along the foreline;

a by-pass line connecting the vacuum pumping arrangement to the chamber and arranged to by-pass the filter volume selectively dependent on monitored characteristics of the chamber or the vacuum system, wherein the by-pass line is downstream of the chamber and upstream of the vacuum pumping arrangement; and a control device comprising a programmable logic device or computer, wherein the control device comprises control lines connected to a plurality of valves configured to control operation of the vacuum system to:

convey gas from the chamber to the vacuum pumping arrangement along the by-pass line at a first range of pressures to reduce a pressure of the chamber to a first predetermined pressure less than atmospheric pressure, wherein gas pumped through the by-pass line does not pass through the filter volume, convey gas from the filter volume along the foreline and through the vacuum pumping arrangement to reduce a pressure of the filter volume to a second predetermined pressure less than the first predetermined pressure, connect the filter volume to the chamber along the foreline in response to the chamber being at the first predetermined pressure and the filter volume being at the second predetermine pressure, wherein gas is conveyed from the chamber to the filter volume by a pressure differential established by the second predetermined pressure being less than the first predetermined pressure, and convey gas from the chamber, through the filter volume, and along the foreline at a second range of pressures less than the first range of pressures.

2. The vacuum system of claim 1, wherein the by-pass line is arranged to connect the vacuum pumping arrangement to the chamber selectively dependent on the pressure in the chamber.

3. The vacuum system of claim 1 or 2, wherein the foreline is arranged to isolate the filter volume from the chamber and the vacuum pumping arrangement when the by-pass line connects the vacuum pumping arrangement to the chamber.

4. The vacuum system of claim 3, wherein the foreline comprises a first isolation valve upstream of the filter volume for isolating the filter volume from the chamber and a second isolation valve downstream from the filter volume for isolating the filter volume from the vacuum pumping arrangement.

5. The vacuum system of claim 1, further comprising a by-pass valve for selectively conveying gas along the by-pass line dependent on the pressure in the chamber.

6. The vacuum system of claim 1, wherein the first range of pressures extends from atmosphere to the first predetermined pressure and the second range of pressures extends from a pressure less than the first predetermined pressure to a target pressure lower than the second predetermined pressure.

7. The vacuum system of claim 1, further comprising a by-pass valve for selectively conveying gas along the by-pass line dependent on the pressure in the chamber, wherein the foreline comprises a first isolation valve upstream of the filter volume for isolating the filter volume from the chamber and a second isolation valve downstream from the filter volume for isolating the filter volume from the vacuum pumping arrangement, wherein, at the first range of pressures, the control device is configured to control the by-pass valve so that gas is conveyed from the chamber to the vacuum pumping arrangement along the by-pass line and to control the first and second isolation valves so that the filter volume is isolated from the chamber and the vacuum pumping arrangement, and wherein, at the second range of pressures, the control device is configured to control the by-pass valve and the first and second isolation valves so that gas is conveyed along the foreline and through the filter volume to the vacuum pumping arrangement.

8. The vacuum system of claim 2, further comprising a by-pass valve for selectively conveying gas along the by-pass line dependent on the pressure in the chamber.

9. The vacuum system of claim 3, further comprising a by-pass valve for selectively conveying gas along the by-pass line dependent on the pressure in the chamber.

10. The vacuum system of claim 6, further comprising a by-pass valve for selectively conveying gas along the by-pass line dependent on the pressure in the chamber, wherein the foreline comprises a first isolation valve upstream of the filter volume for isolating the filter volume from the chamber and a second isolation valve downstream from the filter volume for isolating the filter volume from the vacuum pumping arrangement, wherein, at the first range of pressures, the control device is configured to control the by-pass valve so that gas is conveyed from the chamber to the vacuum pumping arrangement along the by-pass line and to control the first and second isolation valves so that the filter volume is isolated from the chamber and the vacuum pumping arrangement, and wherein, at the second range of pressures, the control device is configured to control the by-pass valve and the first and second isolation valves so that gas is conveyed along the foreline and through the filter volume to the vacuum pumping arrangement.

11. The vacuum system of claim 1, further comprising a by-pass valve for selectively conveying gas along the by-pass line dependent on the pressure in the chamber, wherein the foreline comprises a first isolation valve upstream of the filter volume for isolating the filter volume from the chamber and a second isolation valve downstream from the filter volume for isolating the filter volume from the vacuum pumping arrangement, wherein, at the first range of pressures, the control device is configured to control the by-pass valve so that gas is conveyed from the chamber to the vacuum pumping arrangement along the by-pass line and to control the first and second isolation valves so that the filter volume is isolated from the chamber and the vacuum pumping arrangement, and wherein, at the second range of pressures, the control device is configured to control the by-pass valve and the first and second isolation valves so that gas is conveyed along the foreline and through the filter volume to the vacuum pumping arrangement.

12. The vacuum system of claim 11, wherein the control device is configured to partially equalize a pressure between the chamber and the filter volume prior to conveying the gas from the chamber to the vacuum pumping arrangement through the foreline at the second range of pressures.

13. A method of evacuating a chamber of a metallurgical processing system, the method comprising:

isolating a filter volume in a foreline from the chamber and a vacuum pumping arrangement, wherein the filter volume is configured to filter gas evacuated from the chamber along the foreline;

evacuating, through a by-pass line connecting the vacuum pumping arrangement to the chamber, the chamber from atmosphere to a first predetermined pressure, less than atmosphere, with the vacuum pumping arrangement, wherein the by-pass line is arranged to by-pass the filter volume such that gas pumped through the by-pass line does not pass through the filter volume;

closing a by-pass valve at the first predetermined pressure to disconnect the by-pass line from the chamber;

evacuating the filter volume to a second predetermined pressure less than the first predetermined pressure with the vacuum pumping arrangement using the foreline;

connecting the filter volume to the chamber using the foreline, wherein gas is conveyed from the chamber to the filter volume by a pressure differential established by the second predetermined pressure being less than the first predetermined pressure; and evacuating the filter volume and the chamber with the vacuum pumping arrangement below the second predetermined pressure.

14. The method of claim 13, further comprising:

controlling the by-pass valve so that gas is conveyed from the chamber to the vacuum pumping arrangement along the by-pass line and controlling isolation valves so that the filter volume is isolated from the chamber and the vacuum pumping arrangement while the chamber is evacuated to the first predetermined pressure, and controlling the bypass valve and the isolation valves so that gas is conveyed along the foreline and through the filter volume to the vacuum pumping arrangement while evacuating the filter volume and the chamber below the second predetermined pressure.

* * * * *